United States Patent [19]

Lambert et al.

[11] 4,331,529

[45] May 25, 1982

[54] FLUID COKING AND GASIFICATION PROCESS

[75] Inventors: Merlan M. Lambert, Conroe, Tex.; Joseph P. Matula, Randolph Township, Dover County, N.J.

[73] Assignee: Exxon Research & Engineering Co., Florham Park, N.J.

[21] Appl. No.: 204,390

[22] Filed: Nov. 5, 1980

[51] Int. Cl.[3] ..... C10B 49/10; C10B 55/10; C10J 3/54

[52] U.S. Cl. ..... 208/8 R; 48/197 R; 48/206; 208/127; 252/373

[58] Field of Search ..... 48/197 R, 206; 208/8 R, 208/127; 252/373

[56] References Cited

U.S. PATENT DOCUMENTS

| | | | |
|---|---|---|---|
| 2,527,575 | 10/1950 | Roetheli | 196/55 |
| 2,579,398 | 12/1951 | Roetheli | 48/206 |
| 3,661,543 | 5/1972 | Saxton | 48/206 |
| 3,702,516 | 11/1972 | Luckenbach | 48/206 |
| 3,733,186 | 5/1973 | Zemaites | 48/206 |
| 3,803,023 | 4/1974 | Hamner | 48/197 R |
| 3,923,635 | 12/1975 | Schulman | 208/50 |
| 4,007,092 | 2/1977 | Metrailer et al. | 48/197 R |
| 4,055,484 | 10/1977 | Blaser et al. | 48/63 |
| 4,229,185 | 10/1980 | Sass | 48/197 R |

*Primary Examiner*—Peter F. Kratz

*Attorney, Agent, or Firm*—Marthe L. Gibbons

[57] ABSTRACT

An integrated fluid coking and gasification process is provided in which a portion of the coke is gasified in a first gasification zone in the presence of an oxygen-containing gas to produce a hot gas and hot coke. A portion of the resulting hot coke is gasified in a second gasification zone in the presence of steam to produce a gas comprising hydrogen and carbon monoxide, which is suitable, after conventional shift and clean up, for use as synthesis gas.

19 Claims, 1 Drawing Figure

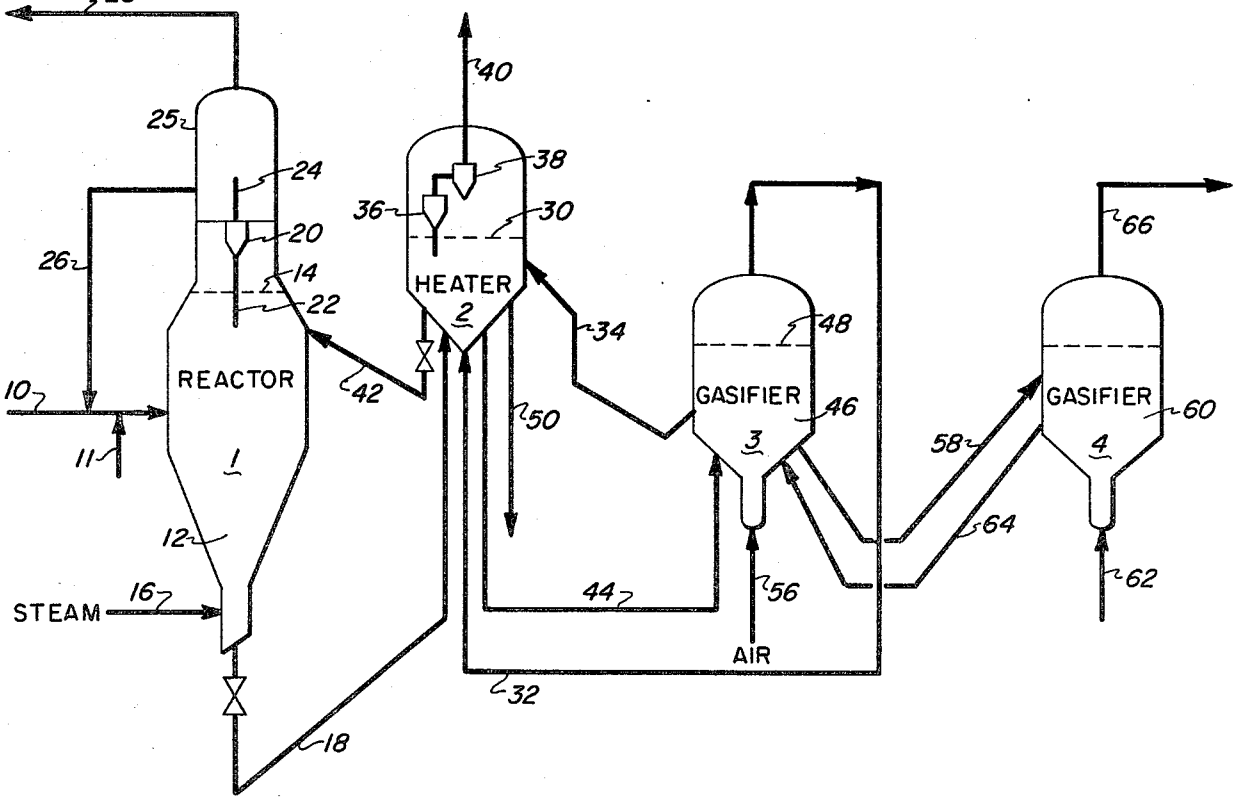
REACTOR
1
HEATER
2
GASIFIER
3
GASIFIER
4
STEAM
AIR
10
11
12
14
16
18
20
22
24
25
26
28
30
32
34
36
38
40
42
44
46
48
50
56
58
60
62
64
66

FLUID COKING AND GASIFICATION PROCESS

BACKGROUND OF THE INVENTION

1. Field of the Invention

This invention relates to an integrated fluid coking and gasification process.

2. Description of the Prior Art

It is known to produce normally liquid hydrocarbons and fuel gases by integrated fluid coking and gasification processes such as those disclosed in U.S. Pat. Nos. 3,661,543; 3,702,516 and 4,055,484, the teachings of which are hereby incorporated by reference.

U.S. Pat. No. 3,803,023 and U.S. Pat. No. 3,726,791 disclose integrated coking and gasification processes in which a hydrogen-rich gas is produced by steam gasification of coke.

U.S. Pat. No. 3,923,635 discloses gasification of coke in a gasifier with steam and, optionally, oxygen. See column 5, lines 29 to 30.

It has now been found that the integration of fluid coking with two separate gasification zones will provide advantages that will become apparent in the ensuing description.

SUMMARY OF THE INVENTION

In accordance with the invention there is provided, an integrated coking and gasification process comprising the steps of: (a) reacting a carbonaceous chargestock in a coking zone containing a bed of fluidized solids maintained at fluid coking conditions to produce a vapor phase product, including normally liquid hydrocarbons, and coke, said coke depositing on said fluidized solids; (b) introducing a portion of said solids with the coke deposit thereon to a first fluid bed gasification zone maintained at gasification conditions; (c) reacting said portion of solids in said first gasification zone with an oxygen-containing gas to produce a first gaseous stream and partially gasified coke; (d) introducing a portion of said partially gasified coke from said first gasification zone to a second fluid bed gasification zone maintained at gasification conditions; (e) reacting said portion of partially gasified coke in said second gasification zone with a gas comprising steam to produce a second gaseous stream, and (f) recycling a portion of said partially gasified coke from said second gasification zone to said first gasification zone.

BRIEF DESCRIPTION OF THE DRAWING

The FIGURE is a schematic flow plan of one embodiment of the invention.

DESCRIPTION OF THE PREFERRED EMBODIMENTS

Referring to the FIGURE, a carbonaceous material having a Conradson carbon residue of about 20 weight percent such as heavy residuum having an initial boiling point (at atmospheric pressure) from about 1000° F.+ is passed by line 10 into a coking zone 12 in which is maintained a fluidized bed of solids (e.g. coke particles of 40 to 1,000 microns in size) having an upper level indicated at 14. Preferably, the carbonaceous feed is mixed with steam to assist in dispersing the feed in the bed. The steam is introduced through line 11 into line 10. Carbonaceous feeds suitable for introduction into the coking zone of the present invention include heavy hydrocarbonaceous oils; heavy and reduced petroleum crudes; petroleum atmospheric distillation bottoms; petroleum vacuum distillation bottoms; pitch, asphalt, bitumen, and other heavy hydrocarbon residues; tarsand oils; shale oil; liquid products derived from coal liquefaction processes, including coal liquefaction bottoms; coal, coal slurries, and mixtures thereof. Typically such feeds have a Conradson carbon residue of at least 5 weight percent, preferably above about 10 weight percent (as to Conradson carbon residue, see ASTM Test D-189-65). A fluidizing gas, e.g. steam, is admitted at the base of coking reactor 1 through line 16 in an amount sufficient to obtain a superficial fluidizing velocity in the range of about 0.3 to about 5 feet per second. Coke at a temperature above the coking temperature, for example, at a temperature from about 100 to 800 Fahrenheit degrees above the actual operating temperature of the coking zone is admitted to reactor 1 by line 42 in an amount sufficient to maintain the coking temperature in the range of about 850° F. to about 1,400° F., preferably at a temperature ranging from about 900 to about 1,200° F. The pressure in the coking zone is maintained in the range of about 0 to about 150 pounds per square inch (psig), preferably in the range of about 5 to about 100 psig. The lower portion of the coker serves as a stripping zone to remove occluded hydrocarbons from the coke. A stream of coke is withdrawn from this stripping zone by line 18 and circulated to heater 2. Conversion products are passed through cyclone 20 to remove entrained solids which are returned to the coking zone through dipleg 22. The vapors leave the cyclone through line 24, and pass into a scrubber 25 mounted on the coker. If desired, a stream of heavy materials condensed in the scrubber may be recycled to the coker via line 26. The coker conversion products are removed from scrubber 25 via line 28 for fractionation in a conventional manner. In heater 2, stripped coke from reactor 1 (cold coke) is introduced by line 18 to a fluid bed of hot coke having an upper level indicated at 30. The bed is partially heated by passing a hot gas into the heater by line 32. Supplementary heat is supplied to the heater by coke circulating in line 34. The gaseous effluent of the heater, including entrained solids, passes through a cyclone, which may be a first cyclone 36 and a second cyclone 38, wherein the separation of the larger entrained solids occurs. The separated larger solids are returned to the heater bed via the respective cyclone diplegs. The heater gaseous effluent, which contains entrained solids, is removed from heater 2 via line 40.

Hot coke is removed from the fluidized bed in heater 2 and recycled to reactor 1 by line 42 to supply heat thereto. Another portion of coke is removed from heater 2 and passed by line 44 to a first gasification zone 46 in gasifier 3 in which is maintained a bed of fluidized coke having a level indicated at 48. If desired, a purge stream of coke may be removed from heater 2 by line 50.

The first gasification zone is maintained at a temperature ranging from about 1,500° F. to 2,000° F., preferably from about 1600° to 1800° F. and at a pressure ranging from 0 to about 150 psig, preferably at a pressure ranging from about 10 to about 60 psig, more preferably at a pressure ranging from about 25 to about 45 psig. A molecular oxygen-containing gas, such as air, which may be air saturated with water vapor, commercial oxygen or air enriched with oxygen is passed by line 56 into gasifier 3. Preferably, the molecular oxygen-containing gas is air saturated with water vapor. Gasifier 3 supplies heat via hot gas (line 32) and hot coke (line 34) to heater 2 and in turn to reactor 1. It also supplies heat via hot coke (line 58) for the endothermic steam-carbon reaction in gasifier 4. The reaction of the coke particles in the gasification zone with the oxygen-containing gas produces a gaseous stream containing some residual hydrogen and carbon monoxide which may be used as fuel gas. The gasifier 3 hot product gas, which may further contain some entrained solids, is removed overhead from gasifier 3 by line 32 and introduced into heater 2 to provide a portion of the required heat, as previously described.

The gases which leave the heater via line 40 have the following typical composition, when air is used in gasification zone 46.

TABLE I

| Constituents | Mole Percent, Including $H_2O + H_2S$ |
|---|---|
| $H_2$ | 9.7 |
| $CH_4$ | 1.6 |
| $H_2O$ | 10.2 |
| CO | 11.7 |
| $CO_2$ | 11.8 |
| $N_2$ | 54.2 |
| $H_2S$ | 0.8 |
| TOTAL | 100 |

Net heating value on a dry basis is about 85 British thermal units per standard cubic foot.

A stream of partially gasified hot coke is withdrawn from gasifier 3 and passed via line 58 to a second fluid bed gasification zone 60 in gasifier 4. A gas comprising steam and which may additionally comprise a molecular oxygen-containing gas is introduced into gasifier 4 by line 62. The molecular oxygen-containing gas may be air, commercial oxygen, and air enriched with oxygen. When it is desired to produce a synthesis gas for making, for example, hydrogen or methanol, no molecular oxygen-containing gas such as air or commercial oxygen is introduced into gasifier 4. Alternatively, when it is desired to produce a synthesis gas for making ammonia, then both steam and an oxygen-containing gas, preferably air, may be introduced into gasifier 4 in proper proportions so that with a subsequent water gas shift reaction (that is, $CO+H_2O \rightarrow H_2+CO_2$) downstream of gasifier 4, the correct proportions of nitrogen and hydrogen will be produced for an ammonia synthesis gas. Gasification zone 60 is maintained at a temperature range of about 1500° F. to 2000° F., preferably from about 1600° F. to 1800° F. and at a pressure ranging from about 0 to 150 psig, preferably at a pressure ranging from about 10 to about 60 psig, and more preferably at a pressure ranging from about 25 to 45 psig.

Reaction of the partially gasified coke with steam in the absence of a molecular oxygen-containing gas and in the absence of molecular nitrogen in gasification zone 60 produces a hydrogen and carbon monoxide-containing gas having the following typical composition.

TABLE II

| Constituents | Mole Percent, Including $H_2O + H_2S$ |
|---|---|
| $H_2$ | 53.0 |
| $CH_4$ | 0.1 |
| $H_2O$ | 8.3 |
| CO | 26.1 |
| $CO_2$ | 0.2 |
| $N_2$ | 0.2 |
| $H_2S$ | 1.2 |

Net heating value (dry basis) of the gas of Table II is about 230 British thermal units per standard cubic foot.

A stream of partially gasified coke is withdrawn from gasification zone 60 and passed to gasification zone 46 by line 64. The hydrogen and carbon monoxide-containing gas produced in gasification zone 60 is removed by line 66. If desired, the gaseous effluent of gasifier 4 may be sent to conventional water-gas shift and purification stages to convert carbon monoxide to hydrogen and carbon dioxide via reaction with steam. The carbon dioxide may then be removed by conventional methods to produce a substantially pure hydrogen stream.

Although in the embodiment shown in the FIGURE, a separate heating zone is shown (heater 2), the process of the invention could also be conducted in a process configuration in which a separate heater, such as heater 2, is omitted. When the heater is omitted, a stream of hot solids from one or from both of the gasification zones would be circulated to and from reactor 1 to provide heat for the coking reaction.

While the process has been described for simplicity of description with respect to circulating coke as the fluidized solids, it is to be understood that the fluidized seed particles on which the coke is deposited may be silica, alumina, zirconia, magnesia, calcium oxide, alundum, mullite, bauxite, and the like.

What is claimed is:

1. An integrated coking and gasification process comprising the steps of:

(a) reacting a carbonaceous chargestock in a coking zone containing a bed of fluidized solids maintained at fluid coking conditions to produce a vapor phase product, including normally liquid hydrocarbons, and coke, said coke depositing on said fluidized solids;

(b) introducing a portion of said solids with the coke deposit thereon to a first fluid bed gasification zone maintained at gasification conditions;

(c) reacting said portion of solids in said first gasification zone with an oxygen-containing gas to produce a first gaseous stream and partially gasified coke and supplying heat from said first gasification zone to said coking zone;

(d) introducing a portion of said partially gasified coke from said first gasification zone to a second fluid bed gasification zone maintained at gasification conditions, said partially gasified coke supplying heat to said second gasification zone;

(e) reacting said portion of partially gasified coke in said second gasification zone with a gas comprising steam in the absence of added oxygen-containing gas to produce a second gaseous stream wherein said second gaseous stream has a higher heating value than the heating value of said first gaseous stream, and (f) recycling a portion of said partially gasified coke from said second gasification zone to said first gasification zone.

2. In the process of claim 1, the additional steps which comprise: passing a portion of said solids with the coke deposit resulting from step (a) from said coking zone to a heating zone operated at a temperature greater than said coking zone temperature to heat said portion of solids; recycling a first portion of heated solids from said heating zone to said coking zone and introducing a second portion of said heated solids to said first fluid bed gasification zone.

3. The process of claim 1 wherein said molecular oxygen-containing gas is air.

4. The process of claim 1 wherein said first gasification zone and said second gasification zone are each maintained at a temperature ranging from about 1500° F. to about 2000° F.

5. The process of claim 1 wherein said first gasification zone is maintained at a temperature ranging from about 1600° to about 1800° F. and said second gasification zone is maintained at a temperature ranging from about 1600° to about 1800° F.

6. The process of claim 1 wherein said coking conditions include a temperature ranging from about 850° F. to 1400° F.

7. The process of claim 1 wherein said coking conditions include a temperature ranging from about 900° F. to about 1200° F.

8. The process of claim 1 wherein said coking conditions include a pressure ranging from about 0 to 150 psig.

9. The process of claim 1 wherein said carbonaceous chargestock has a Conradson carbon content of at least about 5 weight percent.

10. The process of claim 1 wherein said carbonaceous chargestock has a Conradson carbon content of at least about 10 weight percent.

11. The process of claim 2 wherein said first gaseous stream produced in said first gasification zone is passed to said heating zone.

12. The process of claim 2 wherein a portion of solids is passed from said first gasification zone to said heating zone.

13. The process of claim 1 wherein said carbonaceous chargestock comprises a hydrocarbonaceous oil.

14. The process of claim 1 wherein said carbonaceous chargestock comprises coal.

15. An integrated coking and gasification process comprising the steps of:

(a) reacting a carbonaceous chargestock in a coking zone containing a bed of fluidized solids maintained at fluid coking conditions, including a temperature ranging from about 850° F. to about 1400° F., to produce a vapor phase product, including normally liquid hydrocarbons, and coke, said coke depositing on said fluidized solids;

(b) introducing a portion of said solids with the coke deposit thereon into a heating zone operated at a temperature greater than said coking zone temperature to heat said portion of solids;

(c) recycling a first portion of heated solids from said heating zone to said coking zone;

(d) introducing a second portion of said heated solids to a first fluid bed gasification zone maintained at gasification conditions, including a temperature ranging from about 1500° F. to about 2000° F.;

(e) reacting said second portion of said heated solids in said first gasification zone with a molecular oxygen-containing gas to produce a first gaseous stream and partially gasified coke and supplying heat from said first gasification zone to said heating zone of step (b);

(f) introducing a portion of said partially gasified coke from said first gasification zone to a second fluid bed gasification zone maintained at gasification conditions, including a temperature ranging from about 1500° F. to about 2000° F., said partially gasified coke supplying heat to said second gasification zone;

(g) reacting said portion of partially gasified coke in said second gasification zone with a gas comprising steam to produce a second gaseous stream, said second gaseous stream comprising hydrogen and carbon monoxide wherein said second gaseous stream has a higher heating value then the heating value of said first gaseous stream, and (h) recycling a portion of said partially gasified coke from said second gasification zone to said first gasification zone.

16. The process of claim 15 wherein at least a portion of said first gaseous stream of step (e) is passed to said heating zone of step (b).

17. The process of claim 15 wherein said portion of partially gasified coke in said second gasification zone is reacted with a gas comprising steam and a molecular oxygen-containing gas.

18. The process of claim 17 wherein said molecular oxygen-containing gas is air.

19. The process of claim 15 wherein said portion of partially gasified coke in said second gasification zone is reacted with said gas comprising steam in the absence of added oxygen-containing gas.

* * * * *